US006643484B2

(12) United States Patent
Kojima et al.

(10) Patent No.: US 6,643,484 B2
(45) Date of Patent: Nov. 4, 2003

(54) IMAGE FORMING APPARATUS INCLUDING IMAGE BEARING MEMBER ROTATABLE AT DIFFERENT PERIPHERAL VELOCITIES

(75) Inventors: Katsuhiro Kojima, Shizuoka (JP); Tetsuya Kobayashi, Shizuoka (JP); Yasuyuki Ishii, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/082,203

(22) Filed: Feb. 26, 2002

(65) Prior Publication Data

US 2002/0118981 A1 Aug. 29, 2002

(30) Foreign Application Priority Data

Feb. 28, 2001 (JP) ..... 2001-056047

(51) Int. Cl.[7] ..... G03G 15/01; G03G 15/08

(52) U.S. Cl. ..... 399/236; 399/53; 399/101; 399/223

(58) Field of Search ..... 399/53, 43, 236, 399/265, 279, 222, 252, 38, 101, 111, 112, 227, 226, 302

(56) References Cited

U.S. PATENT DOCUMENTS 5,132,733 A * 7/1992 Koizumi et al. ..... 399/279 X
5,402,212 A * 3/1995 Ito et al. ..... 399/111
6,134,395 A * 10/2000 Sasaki et al. ..... 399/53 X
6,219,513 B1 * 4/2001 Ikeda ..... 399/53 X
6,374,065 B1 4/2002 Nishimura et al. ..... 399/53

FOREIGN PATENT DOCUMENTS

| | | | |
|---|---|---|---|
| JP | 58-116559 | | 7/1983 |
| JP | 60-120368 | | 6/1985 |
| JP | 63-271371 | | 9/1988 |
| JP | 06-175466 | * | 3/1994 |
| JP | 09-160374 | * | 6/1997 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member and a developer carrying member, which carries a developer to develop an electrostatic image formed on the image bearing member with the developer. In a non-developmental time period, a peripheral velocity of the developer carrying member is slower than the peripheral velocity of the developer carrying member during a developmental time period. In addition, a peripheral velocity of the image bearing member during the non-developmental time period is slower than the peripheral velocity of the image bearing member during the development time period.

30 Claims, 7 Drawing Sheets

IMAGE FORMING APPARATUS INCLUDING IMAGE BEARING MEMBER ROTATABLE AT DIFFERENT PERIPHERAL VELOCITIES

BACKGROUND OF THE INVENTION

1. Field of the Invention

The present invention relates to an image forming apparatus such as a laser printer, a copying machine, or a facsimile machine and, more particularly to an image forming apparatus suitably designable as an inline-type image forming apparatus which has a plurality of electrostatic latent image bearing members, and in which images formed on the respective electrostatic latent image bearing members are successively transferred onto one intermediate transferring member or a transferring material in a superposition manner to form a multicolor image.

2. Related Art

Various color image forming apparatuses for forming a color image on a transferring material by using an electrophotographic recording system have been devised and some of them have been put to practice.

A representative example of such image forming apparatuses is a type of image forming apparatus which has one photosensitive body used as an electrostatic latent image bearing member, and a plurality of developing apparatuses respectively containing developers of a plurality of colors, and in which electrostatic latent images on the photosensitive body are successively developed by using the developing apparatuses. More specifically, rotary developing apparatuses integrally combined with developing apparatuses for development of four colors: yellow, magenta, cyan, and black are provided around one photosensitive body. Each of electrostatic latent images related to the colors and formed on the common photosensitive body is visualized as a toner image by the corresponding one of the developing apparatuses at a development position reached by the latent image with the rotation of the photosensitive body. Each time one toner image is obtained in this manner, it is transferred onto a transferring material, which is a recording member having a sheet shape such as a paper sheet. These steps are repeated to complete a multicolor image.

Another type of apparatus has also been devised in which toner images in different colors are selectively superposed on the surface of a photosensitive body to form a multicolor toner image on the photosensitive body surface, and the multicolor toner image Is thereafter transferred at a time onto the transferring material.

An inline-type of image forming apparatus different from those described above has also been proposed in which a plurality of photosensitive bodies are used as electrostatic latent image bearing members, and toner images in different colors are separately formed by developing apparatuses of each color respectively facing the photosensitive bodies and are successively transferred onto a transferring material while the transferring material is being conveyed to form a multicolor toner image. Each photosensitive body and other image forming means, including a developing apparatus and a charging device, are integrally combined into an image forming means with respect to each color (hereinafter referred to as "process station"). Process stations thus formed are successively placed along the direction of movement of a transferring material conveying member for conveying the transferring material. There is also a type of image forming apparatus having a similar construction but using a different transferring system such that toner images in different colors are not directly transferred onto a transferring material but successively superposed on an intermediate transferring member to form a multicolor image, which is transferred onto a transferring material at a time. In many cases, each process station is provided in the form of a process cartridge detachably attachable to the image forming apparatus.

Each of the typical types of color image forming apparatus using inline electrophotographic recording systems has both advantages and disadvantages. However, from the viewpoint of the recent development of speedup techniques with the change of market needs, inline systems are considered to be more advantageous than others. Also, intermediate member transfer systems devised as transferring means have the advantage of adaptability to various kinds of transferring material. For this reason, various products using these systems are being designed and put to practice.

However, attempts are being eagerly made to achieve improvements in certain specification items, e.g., reductions in size, weight and power consumption with respect to the above-described color image forming apparatuses. There is also a trend toward machine constructions using components simplified in various respects.

As a method of developing an electrostatic latent image, two-component development methods using a mixture of a toner and a carrier and one-component development methods using a magnetic toner alone are generally known. However, use of a carrier and a need for a so-called ATR mechanism for adjusting the mixing ratio of a toner and a carrier in two-component development methods conflict with requirements for reductions in size and weight.

Non-magnetic one-component development methods disclosed in Japanese Patent Application Laid-open Nos. 58-116559, 60-120368 and 63-271371 attract attention as development methods free from the above-described problem. Non-magnetic one-component development methods require no ATR mechanism, use a simplified arrangement in which charge is caused by friction between a developer, a developer carrying member, and a layer thickness regulating means such as a blade in contact with the developer carrying member, and enable formation of a sharp vivid color image without high-temperature dark transfer failure such as that caused in the case of using a magnetic one-component developer. Therefore, non-magnetic one-component development methods have been used with favorable effects.

In such non-magnetic one-component development methods, a developer carrying member is coated with a developer by a layer thickness regulating means such as a blade, and the developer is charged by friction against the blade or the surface of the developer carrying member. However, if the thickness of the coat is increased, developer particles not sufficiently charged exist. Such developer particles are liable to cause fog and to scatter. Therefore, there is a need to regulate the thickness of the developer coating layer to a sufficiently small value, and it is necessary to maintain the blade in pressure contact with the developer carrying member at a sufficiently high pressure. The force received by the developer in this state is larger than that received by a developer in a two-component development method or a one-component development method using a magnetic toner. A non-magnetic one-component development method is also known which uses an elastic roller in place of a blade as a means for regulating the developer layer thickness on a developing roller provided as a developer carrying member. The elastic roller contacts the developing roller at an upstream position in the direction of rotation of the developing roller. The elastic roller has the function of scraping off toner left on the developing roller instead of being fed for development, and newly supplying toner onto the developing roller.

In the arrangement using the blade or the elastic roller, toner on the developing roller rubs on the blade or the elastic roller. As the toner undergoes a larger number of repeated cycles of rubbing, an externally added material adsorbed to the toner surface is liberated or embedded in the toner resin. Such a toner degradation phenomenon becomes considerable if the time period during which toner on the developing roller rubs on the blade or the elastic layer, i.e., the rotating time of the developing layer, is increased. In particular, in the latter half of the life of toner, image degradations, such as fog, a reduction in density, and a defect due to transfer failure, occur.

In the case of an inline-type image forming apparatus which forms a multicolor image, the photosensitive drums and the developing rollers in all of process stations provided as image forming means are driven during most of the printing time from pre-rotation at an image formation preparatory stage to post-rotation for a cleaning operation or the like after-image formation. The rotational speeds of the photosensitive drums and the developing rollers are not changed, and these rotating components continue rotating at the maximum speed for a long time. Therefore, this image forming apparatus is disadvantageous in terms of degradation of the developer in comparison with a below-described image forming system using rotary developing apparatuses including developing apparatuses for development of four colors, yellow, magenta, cyan, and black.

To prevent toner degradation, in an inline system, a method may be used in which the photosensitive drum and the developing roller in the process stations not operating for image forming (charging, development, transfer, etc.) in the printing time from pre-rotation to post-rotation are stopped. This method, however, maximizes the relative speed between the transferring material conveying member or the intermediate transferring member and the photosensitive drum, so that local rubbing of the surface of the photosensitive drum on the transferring material conveying member or the intermediate transferring member occurs during the stoppage period. As a result, the photosensitive drum surface is scratched by a slide friction on to cause image defects.

The above-described problems may be solved by a method in which the process stations not operating for image forming (charging, development, transfer, etc.) in the printing time are spaced apart from the transferring material conveying member or the intermediate transferring member, and the photosensitive drums and the developing rollers therein are stopped. This method, however, requires a spacing mechanism which is set in the image forming apparatus to enable each of the process stations in the image forming apparatus to be spaced from the transferring material conveying member or the intermediate transferring member independently of the others, resulting in an increase in size of the apparatus and an increase in manufacturing cost.

Further, the rotating time of the developer carrying member varies depending on paper passage modes. In a situation where the frequency of continuous printing is low, pre-rotation and post-rotation are frequently performed. As a result, driving time of the developing roller is increased. Therefore, a considerable image defect due to toner degradation may occur even during the nominal life, depending on operating conditions.

SUMMARY OF THE INVENTION

An object of the present invention is to provide an image forming apparatus which can be used for a long time without degradation of a developer.

Another object of the present invention is to provide an image forming apparatus in which the time period during which a developer carried on a developer carrying member rubs on another component is reduced.

Still another object of the present invention is to provide an image forming apparatus arranged to prevent shortening of the life of an image bearing member.

A further object of the present invention is to provide an image forming apparatus smaller in size and having a reduced manufacturing cost.

Still a further object of the present invention is to provide an image forming apparatus capable of changing the peripheral velocity of a developer carrying member between a development period and a non-development period.

These and other objects and features of the present invention will become apparent from the following detailed description of preferred embodiments of the present invention in conjunction with the accompanying drawings.

DESCRIPTION OF THE PREFERRED EMBODIMENTS

Figure 1:
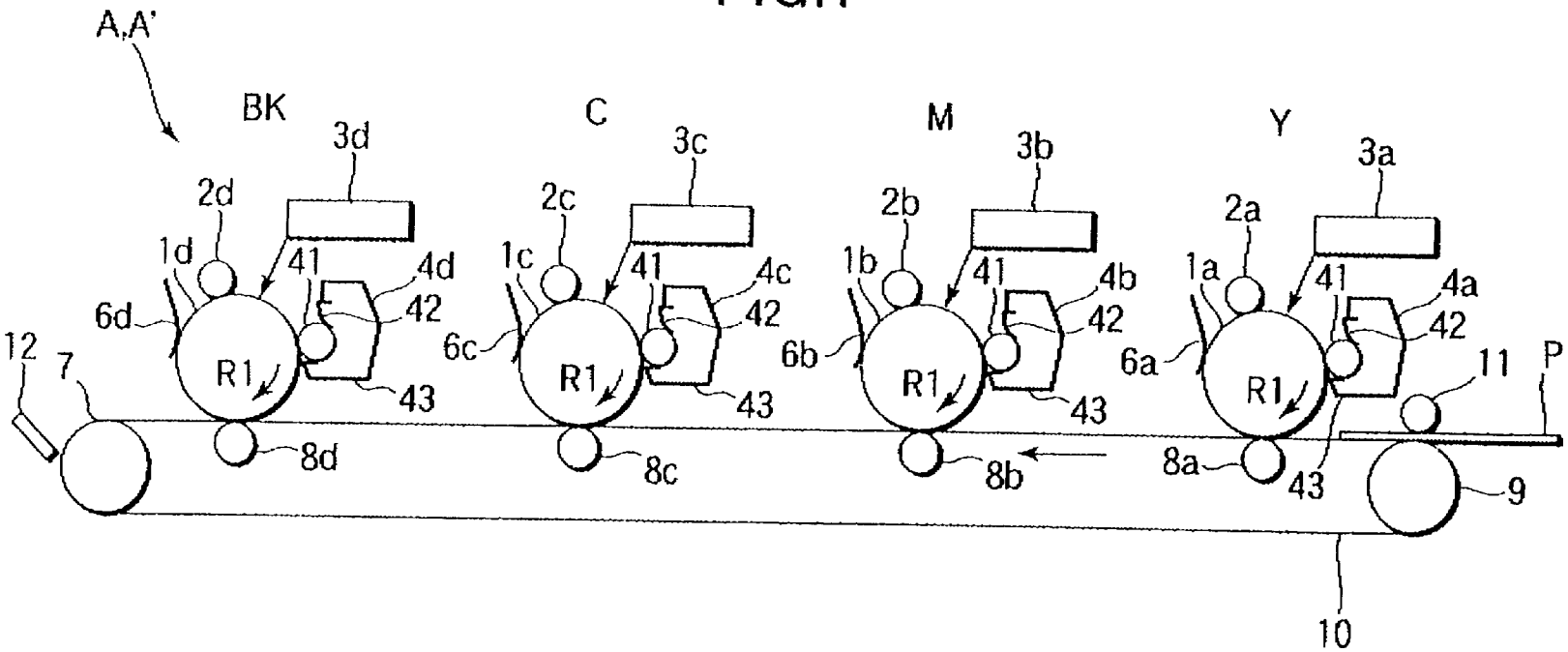
FIG. 1 is a diagram showing the construction of an image forming apparatus A of the present invention.

An image forming apparatus in accordance with the present invention will be described below in detail referring to the accompanying drawings.

Embodiment 1

The construction of an image forming apparatus A which is an example of a color image forming apparatus in accordance with the present invention will be described referring to FIG. 1. The image forming apparatus A is an inline-type image forming apparatus having process stations Y, M, C, and Bk which are first to fourth image forming means independently forming developer images of yellow (Y), magenta (M), cyan (C), and black (Bk), respectively. The process stations Y, M, C, and Bk are horizontally arranged in a row from an upstream position to a downstream position (from right to left as viewed in FIG. 1) along the direction of movement of a transferring belt 10 provided as a transferring material conveying member for conveying a transferring material P used as an image receiving material (direction of rotation, direction of an arrow). Developer images (toner images) in different colors formed by the first to fourth process stations Y, M, C, and Bk are successively transferred onto the transferring material P attracted to the surface of the transferring belt 10 to form a full-color image from the four colors.

Each of the first to fourth process stations Y, M, C, and Bk may be formed as a process cartridge detachably attachable to the image forming apparatus by integrally combining the corresponding one of photosensitive bodies 1*a* to 1*d*, which are electrostatic latent image bearing members, and the corresponding one of developing means 4*a* to 4*d*. This arrangement is preferable in terms of maintenance. For example, referring to FIG. 2, charging rollers 2*a* to 2*d* as primary changing means, and photosensitive body cleaning means 6*a* to 6*b* are further combined integrally with process cartridges 20*a*, 20*b*, 20*c*, and 20*d* detachably attachable to the image forming apparatus A of this embodiment.

In this embodiment, a cylindrical member formed of a negatively chargeable organic OPC (organic photosemiconductor) and having a diameter of 20 mm is used as each of the electrostatic latent image bearing members, i.e., the optical semiconductor photosensitive drums 1*a* to 1*d*. Each of the optical semiconductor photosensitive drums 1*a* to 1*d* is driven to rotate at a peripheral velocity (process speed) of 100 mm/sec in the direction of arrow R1 at the time of image forming.

Primary chargers 2*a*, 2*b*, 2*c*, and 2*d*, exposing apparatuses 3*a*, 3*b*, 3*c*, and 3*d*, developing apparatuses 4*a*, 4*b*, 4*c* and 4*d*, transferring members 8*a*, 8*b*, 8*c*, and 8*d*, and cleaning blades (electrostatic latent image bearing body cleaning means) 6*a*, 6*b*, 6*c*, and 6*d* are respectively disposed around the photosensitive drums 1*a* to 1*d* in this order along the direction of rotation of the drums.

The photosensitive drums 1*a* to 1*d* are uniformly charged during their rotation by the primary chargers, i.e., primary charging rollers 2*a*, 2*b*, 2*c*, and 2*d*, to have a predetermined potential with a predetermined polarity, and then undergo image exposure processing performed by the exposure apparatuses 3*a*, 3*b*, 3*c*, and 3*d*. Thus, electrostatic latent images corresponding to first to fourth color-component images (yellow, magenta, cyan and black component images for a color image to be obtained are formed on the photosensitive drums 1*a* to 1*d*. Each of the primary charging rollers 2*a* to 2*d* has an actual resistance of $1\times10^6$ Ω and has a DC voltage of −1.2 kV applied thereto. Each primary charging roller is kept in contact with the photosensitive drum 1*a*, 1*b*, 1*c*, or 1*d* by a total pressing force of 9.8 N (newton) and is driven to rotate with the rotation of the photosensitive drum. By application of the voltage, the surfaces of the photosensitive drums 1*a* to 1*d* are charged to −600 V.

The exposing apparatuses 3*a* to 3*d* used in this embodiment are polygon scanners using a laser diode. The exposing apparatuses 3*a* to 3*d* form imaging spots of laser beams modulated with image signals on the photosensitive drums 1*a* to 1*d* to form electrostatic latent images. Laser exposure writing on each scanning line is started after a delay of a predetermined time period from a position signal in the polygon scanner called a beam detector (BD) with respect to the main scanning direction (a direction perpendicular to the transferring material forwarding direction) and after a delay of a predetermined time period from a top of page (TOP) signal generated from a switch (not shown) in the transferring material conveyance path with respect to the subscanning direction (transferring material forwarding direction), thereby performing exposure always at the same position on the photosensitive drums 1*a* to 1*d* in the first to fourth process stations Y, M, C and Bk.

The electrostatic latent images are developed by the developing apparatuses 4*a*, 4*b*, 4*c*, and 4*d* in the first to fourth process stations Y, M, C, and Bk. Each of the developing apparatuses 4*a* to 4*d* has a developer carrying member, i.e., developing sleeve 41 placed at an opening of a developer container 43 so as to face the photosensitive drum 1*a*, 1*b*, 1*c*, or 1*d*. The developing sleeve 41 is an elastic roller provided as a member for carrying a developer. By means of the developing sleeve 41, a toner of the corresponding color is attached to the electrostatic latent image on photosensitive drum 1*a*, 1*b*, 1*c*, or 1*d* to develop a toper image. The developing sleeve 41 is pressed against the photosensitive drum. The developer contained in each of the developing apparatuses 4*a*, 4*b*, 4*c*, and 4*d* is a nonmagnetic toner (nonmagnetic one-component developer) containing no magnetic material, and development of the electrostatic latent image is performed by a nonmagnetic one-component contact development method. In this embodiment, a layer thickness regulating blade 42 attached to an opening portion of the developer container 43 on the upstream side of the development position of the developing sleeve 41 in the direction of rotation is used as a means for regulating the thickness of the layer of the developer attached to the surface of the developing sleeve 41 in each of the developing apparatuses 4*a* to 4*d*.

Each of the developing sleeves 41 is rotated at a constant speed, a 170% process speed in this embodiment, in the forward direction relative to the corresponding one of the photosensitive drums 1*a*, 1*b*, 1*c*, and 1*d*, while a developing bias which can be changed according to a signal from a controller is applied to the developing sleeve 41, thereby performing development.

The transferring material conveying member, i.e., the transferring belt 10, is wrapped around a drive roller 7 and a driven roller 9. By the drive roller 7 rotating counterclockwise, the transferring belt 10 is driven to rotate in the direction of the arrow at the same process speed as that at which the photosensitive drums 1*a* to 1*d* are rotated during development. The transferring belt 10 is an endless resin belt formed of a single layer of polyvinylidene fluoride (PVDF) having a thickness of 100 μm and having its resistance adjusted to $1\times10^{10}$ Ω cm. Ribs are formed at two opposite ends on the back side of the belt to prevent the belt from meandering or moving off the center of the path.

Transferring rollers 8*a*, 8*b*, 8*c*, and 8*d* having its volume resistivity adjusted to $1\times10^5$ Ω cm are used as the transferring members to press the transferring belt 10 against the surfaces of the photosensitive drums 1*a* to 1*d* by pressing the back surface of the transferring belt 10. A positive transferring bias is applied to the transferring rollers 8*a* to 8*d* by a transferring bias source (not shown) to enable the toner images on each of the photosensitive drums 1*a* to 1*d* to be successively transferred onto the surface of the transferring material P.

The photosensitive drum cleaning blades 6*a*, 6*b*, 6*c*, and 6*d* provided as means for cleaning the photosensitive drums 1*a* to 1*d* remove toner (transfer residual toner) remaining on the surfaces of the photosensitive drums 1*a* to 1*d* instead of being transferred onto the transferring material P. Further, the cleaning blades 6*a* to 6*d* remove toner attached to the photosensitive drums 1*a* to 1*d* by a jam, registration sensing and density sending toner formed on the transferring belt 10, toner attached to the surface of the transferring belt 10 at the time of occurrence of a jam and reversely transferred onto the photosensitive drums 1*a* to 1*d*, etc. All these toner residuals will be referred to as "unnecessary toner".

In the image forming apparatus constructed as described above, transferring material P is fed from a paper cassette (not shown), passes a resist roller (not shown), and is brought into contact with the transferring belt 10 through a transfer entrance guide (not shown).

It is preferred that in the image forming apparatus constructed as described above transferring material P be attracted to the transferring belt 10 sufficiently strongly.

Transferring material P is brought into contact with the transferring belt 10 through the transfer entrance guide and, at this time, an attraction member or attraction roller 11 provided in the vicinity of the point of contact between the transferring material P and the transferring belt 10 functions to enable the transferring material P to be attracted to the transferring belt 10. The attraction roller 11 is placed so that the transferring belt 10 is pinched between the attraction roller 11 and the driven roller 9, which is one of the rollers around which the transferring belt 10 is wrapped. During image forming operation, a voltage of +1 kV is applied to the attraction roller 11 to supply charge to the transferring material P and to thereby produces an attraction force. By this attraction force produced by the attraction roller 11, the transferring material P is attracted to the surface of the transferring belt 10.

The transferring material P given the force for attraction to the transferring belt 10 enters first process station Y as the first image forming means. To the transferring material P, in the transferring section, a toner image of the first color yellow is transferred from the photosensitive drum 1*a* by the transferring roller 8*a* provided at the back of the transferring belt 10. The resistance of the transferring roller 8*a* used in this embodiment is adjusted to $1\times10^5$ Ω cm. Under this condition, the contact nip width between the transferring roller 8*a* and the transferring belt 10 along the direction of rotation of the transferring belt 10 (the direction of the arrow) is 1.5 mm. A DC bias of +2 kV is applied to the transferring roller 8*a* from a high voltage source.

Thereafter, each time the transferring material P passes the process stations M, C, and Bk as one of the other image forming means, with the rotation of the transferring belt 10 along the direction of the arrow, a toner image of the corresponding one of the other colors from the photosensitive drums 1*b*, 1*c* and 1*d* is transferred onto the transferring material P, thus superposing the toner images in the four colors one on another on the transferring belt 10.

In this embodiment, to absorb the influence on transferred contrast of transferring charge supplied to transferring material P on the transferring belt 10 in the first to fourth process stations Y, M, C, and Bk, the transferring bias is increased in steps of 300 V from the upstream-end process station to the downstream-end process station, and the transferring bias to be initially applied is set to such a voltage that the transferring bias at the fourth process station Bk is 2.9 kV. The transferring bias setting is thus made to prevent transfer failure.

The transferring material P having the toner images in the four colors transferred thereto separates from the transferring belt 10 at the downstream end (trailing end) because of the existence of a curvature of the belt. Thereafter, the four color toner images on the surface are fixed by heating and pressing performed by a fixing apparatus (not shown), thereby completing formation of a full-color image from the four colors. The transferring material P is then expelled out of the main body of the image forming apparatus A.

In the image forming apparatus A having the above-described transfer belt 10, if toner is attached to the two surfaces of the belt 10 to stay thereon as residual toner, it may cause a smudge on the reverse surface of transferring material P and image smudge. For example, a toner residual results from attachment of toner caused by a paper jam or attachment of fogging toner to an non-image forming portion, or toner images formed for color misalignment detection enabling color misalignment control and toner image density control are transferred from the photosensitive drums 1*a* to 1*d*.

Toner remaining on or attached to the transferring belt 10 as described above is removed by a transferring belt cleaning means (cleaning blade) 12.

Figure 3:
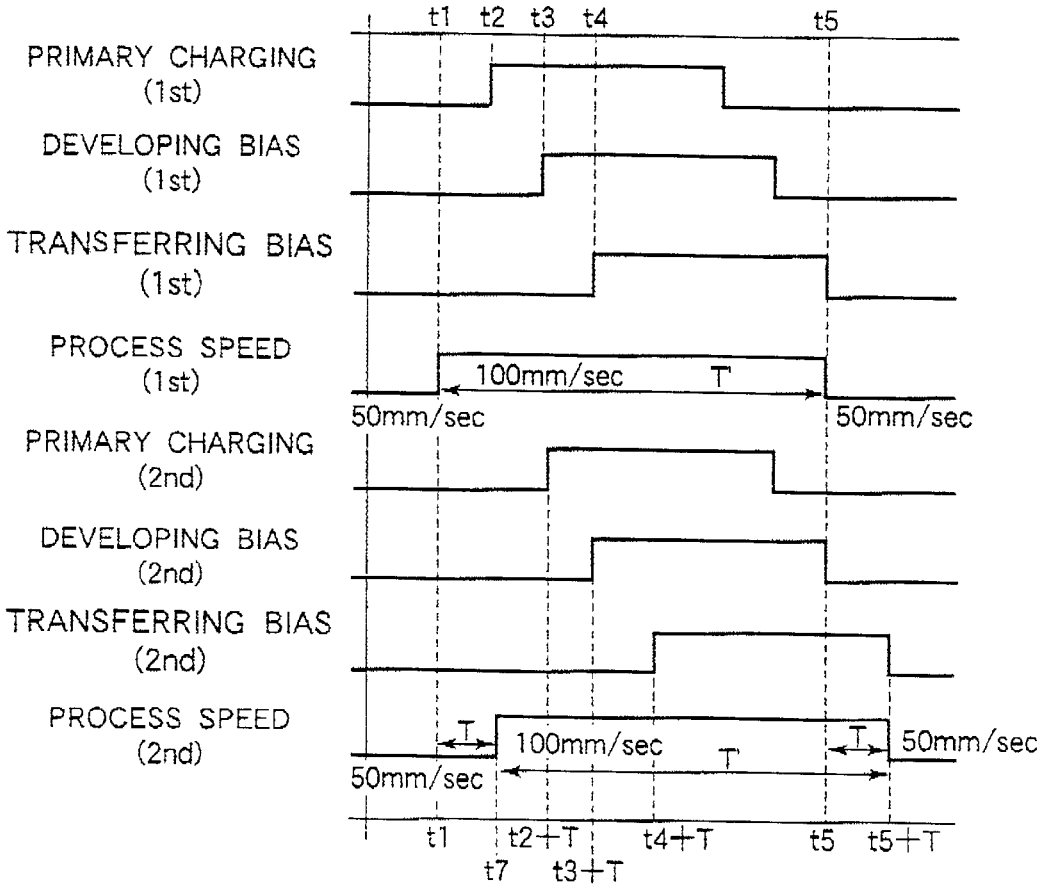
FIG. 3 is a timing chart of image forming means in the image forming apparatus of the present invention.

Image forming timing with respect to application of voltages, exposure, etc., in the image forming apparatus A of FIG. 1, and change of the rotational speed of the photosensitive drums 1*a* to 1*d*, which is a feature of the present invention, will be described referring to the timing chart of FIG. 3. The timing chart of FIG. 3 shows timing of the first and second process stations while omitting timing chart of the third and fourth process stations.

When code information which is image information is received, decompression of the code information on a first page into image data is started in a control section including a microprocessor. Simultaneously with the completion of receiving of the code information on the first page, rotation of a drive motor is started to drive and rotate the photosensitive drums 1*a* to 1*d* at a process steed of 50 mm/sec. The scanners are also rotated.

Simultaneously with operation of the drive motor, paper feed is started. Feed of transferring material P with the registration roller (not shown) is temporality inhibited and completion of decompression of the image information is awaited. Subsequently, the primary charging voltage, the developing bias and the transferring bias are applied and pre-rotation for adjustment of laser beam output etc., which is for preparation of image forming, is started. Thereafter, an operation (paper feed pickup operation) for conveying the transferring material P to a position at the registration roller is performed by driving a feed roller with timing enabling synchronization between images on the photosensitive drums 1 and the transferring material P. If pre-rotation is not completed when image data decompression for the first page is completed, reading of the image data is not started. Simultaneously with the completion of pre-rotation, reading of the image data, i.e., exposure, is started.

Change of the speed of the photosensitive drums 1*a* to 1*d* will now be described. When t=t1, that is, at a time (t=t2) when the photosensitive drum 1*a* facing the paper leading end position at the first process station Y contacts the charging roller 2*a*, or at an earlier time, the process speed of the photosensitive drum 1*a* is changed to 100 mm/sec. That is because the speed of the photosensitive drum 1*a* is changed, thereby preventing disturbance in the charging potential on the photosensitive drum 1*a*.

While the image data is being read, laser light from the exposure means 3*a* is modulated to write a toner image on the photosensitive drum 1*a*. At a time t=t3 when the electrostatic latent image written by laser exposure on the photosensitive drum 1*a* is brought to the development position by the rotation, the developing bias is applied to perform development.

At a time t=t4 when the toner image portion written on the photosensitive drum 1*a* is brought to the position for contact with the transferring material P on the transferring belt by the rotation, the transferring bias is applied to transfer the yellow toner image onto the transferring material P.

Thereafter, at a time t=t5 when the trailing end of the transferring material P passes the position at which the photosensitive drum 1*a* and the transferring member contact with each other, the process speed of the photosensitive drum 1*a* is again changed to 50 mm/sec.

Thus, the image forming time during which the higher process speed of the photosensitive 1*a* is achieved is the time period from the moment at which the image forming apparatus A receives image information from the outside to the moment at which transfer of the corresponding image onto the transferring material P is completed, i.e., T' from t=t1 to t=t5 (T'=t5−t1).

Speed change at the second station M will next be described. If the time when the photosensitive drum 1*b* of the second station M is brought into contact with the charging roller 2*b* is assumed to be t7, the time difference T (=t7−t1) from the point in time t1 at when the photosensitive drum 1*a* of the first station Y is brought into contact with the charging roller 2*a* corresponds to the time required to move the transferring belt 10 through the distance between the process stations Y, M, C, and Bk. Each of timing of changing the process speed and timing of application of biases for charging, developing and transferring is set with a delay of T from that at the first station Y. Each of the photosensitive drums 1*b* to 1*d* of the second to fourth stations M to Bk is rotated at the process speed of 100 mm/sec for the time period T', as is the photosensitive drum 1*a* of the first process station Y.

Figure 4:
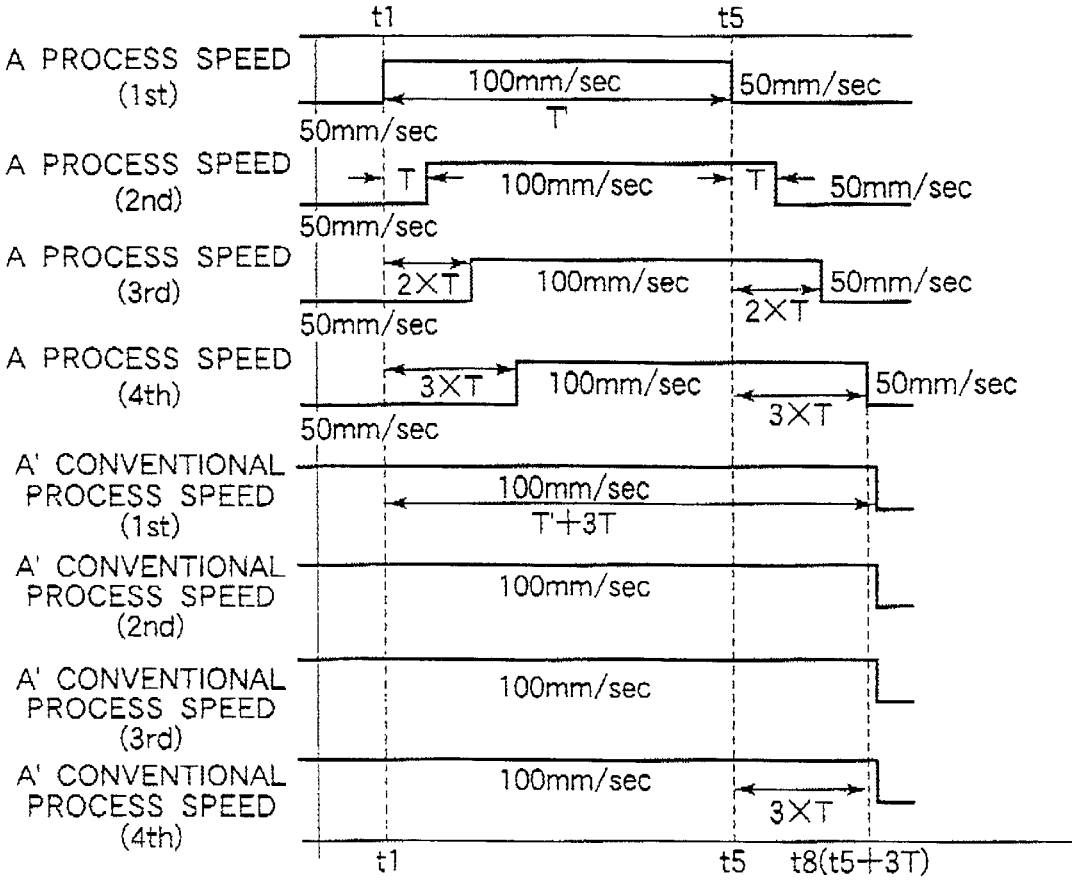
FIG. 4 is a timing chart of the process speed in the image forming apparatus A of the present invention and the process speed in a conventional image forming apparatus A'.

As shown in FIG. 4, the same change in speed is made at each of the third and fourth stations C and Bk with a delay two or three times longer than T from that made at the first station.

When the fourth station image forming operation is completed, post-rotation is performed to complete the job.

According to the conventional art, all the photosensitive drums 1*a* to 1*d* are rotated at the maximum speed through the time period from pre-rotation before image formation at the first station Y to the completion of post-rotation after the completion of image formation at the fourth station Bk. FIG. 4 is a timing chart showing timing of the process speed in the image forming apparatus A and timing of the process speed of photosensitive drums 1*a* to 1*d* of a conventional image forming apparatus A' having substantially the same construction as the image forming apparatus A except the process speed of the photosensitive drums 1*a* to 1*d*. In the conventional image forming apparatus, as shown in the timing chart of FIG. 4, the photosensitive drums are rotated at a process speed of 100 mm/sec till a point in time exceeding a point in time t8=t5+3T corresponding to the time period from a start of the operation of the photosensitive drum 1*a* of the first station Y to the completion of the operation of the photosensitive drum 1*d* of the fourth station Bk, that is, the photosensitive drums are rotated at that speed through a time period longer than T'+3T. According to the method of this embodiment, each of the photosensitive drums 1*a* to 1*d* is rotated at the maximum speed only during the image forming operation at each of the station Y, M, C, and Bk, i.e., during a time period of T', shorter by 3T or more than that in the case of the conventional art. When the image forming operation of each of the stations Y, M, C, and Bk is not performed, the process speed of the corresponding photosensitive drum 1*a*, 1*b*, 1*c*, or 1*d* is set to the reduced speed of 50 mm/sec and the photosensitive drum is not completely stopped. The difference between the rotational speed of the transferring belt 10 and the rotational speed of each of the photosensitive drum 1*a* to 1*d* is not increased except when development is performed, thereby moderating rubbing of the transferring belt 10 and the photosensitive drums 1*a* to 1*d*.

In this embodiment, as described above, each developer carrying member has, in some cases, during a non-development period, a peripheral velocity lower than the peripheral velocity that it has at the time of development, and the process speed of the photosensitive drums 1*a* to 1*d* is reduced when image forming is not performed. The ratio of the rotational speed (peripheral velocity) of the photosensitive drums 1*a* to 1*d* and the rotational speed (peripheral velocity) of the developing sleeves 41 is always constant and the rotational speed of the developing sleeves 41 is higher than the rotational speed of the photosensitive drums 1*a* to 1*d* and is kept at 170% of the rotational speed of the photosensitive drums 1*a* to 1*d*. Thus, the process speed of the photosensitive drums 1*a* to 1*d* and the rotational speed of the developing sleeves 41 are set in correspondence with each other. That is, since the process speed of the photosensitive drums 1*a* to 1*d* is reduced when image forming is not performed, the rotational speed of the developing sleeve 41 is also reduced. Thus, chances of rubbing of toner and the developing blade 42 are reduced, whereby the above-described speed control is effective in suppressing image defects due to toner degradation.

It is desirable that the rotational speed of the developing sleeve during a non-development period be ⅔ or less of the rotational speed at the time of development. This is because the rotational speed of the developing sleeve during a non-development period is set in correspondence with the rotational speed of the photosensitive drum during the corresponding time period, and because the effect of reducing image defects due to toner degradation is enhanced if the speed is reduced to ⅔ or less. When the rotational speed is reduced to ⅔ or less, the increase in temperature caused by rubbing of the toner on the developing roller on the blade and the elastic roller is effectively suppressed, thereby preventing toner degradation due to the increase in temperature.

It is desirable that the "non-development period" during which the rotational speed of the developing sleeve is reduced be a period III (non-image-forming period) defined by subtracting a period II from the time at which the portion of the image bearing member corresponding to the leading end of an image in the printing operation is charged with the charging member to the time at which the portion of the image bearing member corresponding to the trailing end of the image passes the transferring section from a period I from the time at which an image forming start signal is input to the image forming apparatus from the outside to cause the image bearing member, the transferring material conveying member and the intermediate transferring member to start rotating (the time at which ante-rotation is started) to the time at which, after the completion of image forming, the rotation of the image bearing member, the transferring material conveying member and the intermediate transferring member is stopped (the time at which ante-rotation is stopped).

Since during the period III the transferring material conveying member and the intermediate transferring member continue rotating, it is preferable to set the rotational speed of the image bearing member during the non-development period to such a reduced value relative to the speed at the time of development that occurrence of scratches in the surface of the image bearing member caused by rubbing against the transferring material conveying member and the intermediate transferring member is negligible.

As described above, in the inline-type image forming apparatus, the rotational speed of the image bearing member during the non-development period is reduced relative to the rotational speed at the time of development. Even in a case where a non-magnetic one-component development system is used, the present invention realizes an image forming apparatus smaller in size and having a reduced manufacturing cost without considerably reducing the life of the electrostatic latent image bearing member and the life of the developer. It is also possible to realize an image forming apparatus having improved maintainability by combining image forming means into a cartridge.

While the developer used in this embodiment has been described as a non-magnetic one-component developer, the present invention can also be applied to an image forming apparatus using a magnetic one-component developer or a two-component developer. Also, a noncontact development system may alternatively be used.

The layer thickness regulating means in the developing apparatus is not limited to a blade-like member. A member in the form of a roller may alternatively used to achieve the same effect.

Embodiment 2

Figure 5:
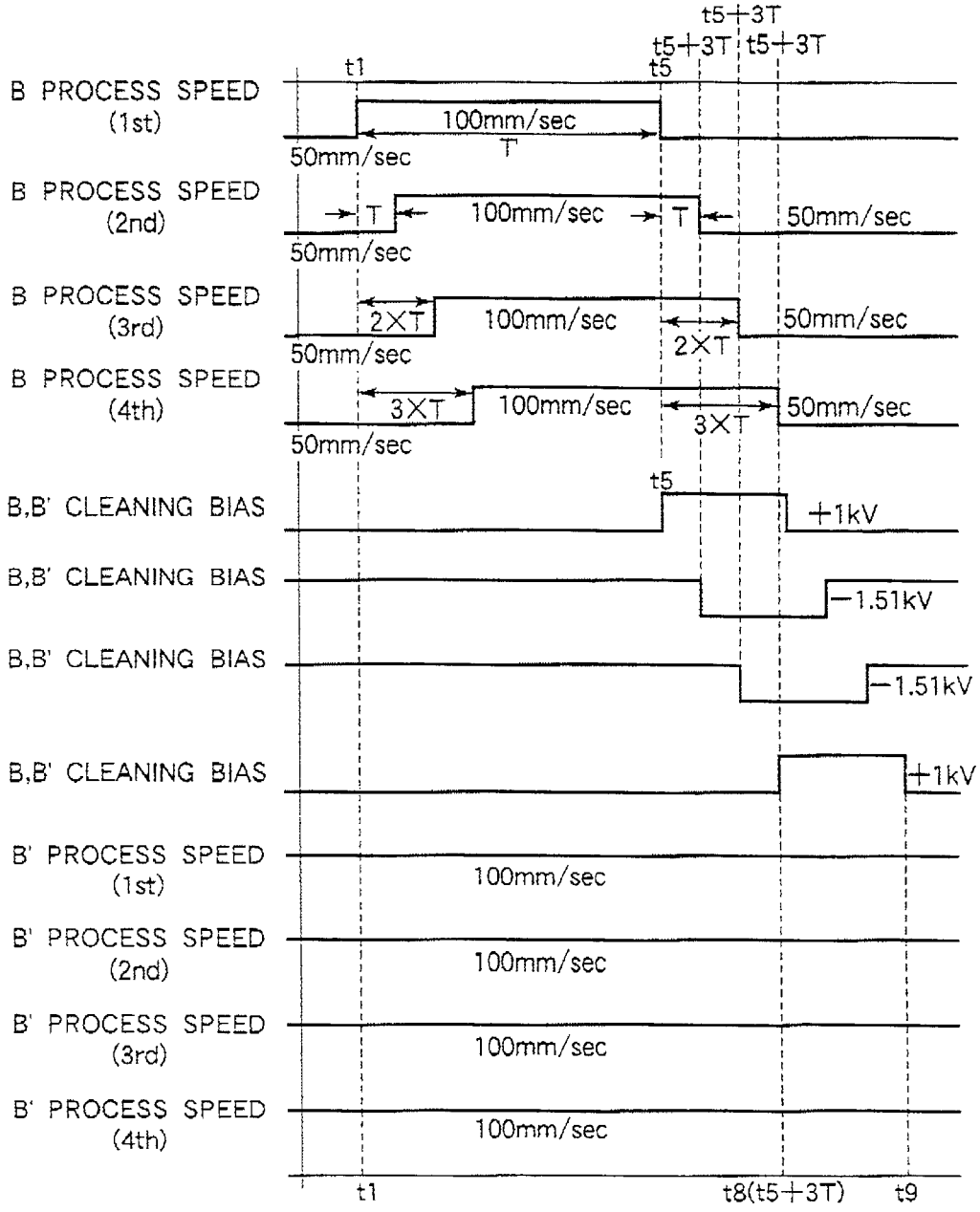
FIG. 5 is a timing chart of the process speed and transferring belt cleaning means in an image forming apparatus B of the present invention and the process speed in the conventional image forming apparatus B'.

An image forming apparatus B which represents a second embodiment of the present invention has the same construction as that of the image forming apparatus A of Embodiment 1 described above referring to FIG. 1 except that the cleaning blade 12 on the transferring belt 10 is not used. When the image forming apparatus B receives image information supplied from the outside, and when the exposure system, etc., starts operating, each of the apparatuses in the stations Y, M, C, and Bk are started and each of the photosensitive drums 1*a* to 1*d* is rotated as shown in FIG. 5. That is, in pre-rotation, each of the photosensitive drums 1*a* to 1*d* starts rotating at a process speed of 50 mm/sec. At the time of forming a toner image with each of the photosensitive drums 1*a* to 1*d*, the photosensitive drum rotates at an increased speed of 100 mm/sec. After the toner image has been transferred onto the transfer belt, the speed is reduced to 50 mm/sec again and post-rotation is continued until cleaning on the transferring belt 10, the photosensitive drums 1*a* to 1*d*, etc., is completed.

The image forming apparatus B does not use the transferring belt cleaning blade 12 described in Embodiment 1 but uses a bias cleaning system in which a cleaning bias is applied to the transferring rollers 8*a* to 8*d* to which the transferring bias is applied.

Therefore, a description will now be made of a cleaning means for removing toner remaining on or attached to the transferring belt 10 by using a cleaning bias and the process speed of the photosensitive drums 1*a* to 1*d* during post-rotation.

In this embodiment, unnecessary toner on the transferring belt 10 is removed by being electrostatically and reversely transferred to the photosensitive drums 1*a* to 1*d* and by using the cleaning blades 6*a* to 6*d* for cleaning on the photosensitive drums 1*a* to 1*d*.

In this embodiment, since unnecessary toner attached to the transferring belt 10 exists with positive and negative polarities, the polarities of the voltages applied to the transferring rollers 8*a*, 8*b*, 8*c*, and 8*d* are appropriately changed to cause reverse transfer to the photosensitive drums 1*a* to 1*d*, thereby cleaning the transferring belt 10. That is, at the time of cleaning, a voltage with a positive polarity is applied to the transferring rollers 8*a* and 8*d* and a voltage with a negative polarity is applied to the transferring rollers 8*b* and 8*c*. Toner positively charged is reversely transferred to the photosensitive drums 1*a* and 1*d*, while toner negatively charged is reversely transferred to the photosensitive drums 1*b* and 1*c*.

This process will be described in detail. To the transferring roller 8*a*, a voltage of 1 kV with the same polarity as that of the voltage applied at the time of image forming (+2 kV in Embodiment 1) is also applied when transferring belt cleaning is performed. The cleaning bias is applied when the trailing end of transferring material P passes the nip between the photosensitive drum 1*a* and the transferring roller 8*a* (at a time=t5), and when a signal is output from a control section including a microprocessor to change the transferring bias to the cleaning bias. Thus, toner with the polarity opposite to that of normally charged toner is transferred onto the photosensitive drum 1*a* and is removed by the cleaning blade 6*a* to be collected in a waste toner container.

Next, the cleaning bias is applied to the transferring roller 8*b*. A voltage of −1.5 kV with the polarity opposite to that of the voltage applied at the time of image forming (+2.3 kV in Embodiment 1) is applied to cause negatively charged toner not collected to the photosensitive drum 1*a* to be reversely transferred to the photosensitive 1*b*. The toner reversely transferred to the photosensitive drum 1*b* is removed by the cleaning blade 6*b* to be collected in the waste toner container. The cleaning bias is applied to the transferring roller 8*b* when the trailing end of transferring material P passes the nip between the photosensitive drum 1*b* and the transferring roller 8*b* (at a time=t8), and when a signal is output from the control section including a microprocessor to change the bias applied to the transferring roller 8*b* from the transferring bias to the cleaning bias.

However, when the amount of unnecessary toner on the transferring belt 10 is excessively large, the entire amount of toner cannot be removed and collected. Therefore, a voltage of −1.5 kV and a voltage of +1.0 kV are also applied respectively to the transferring rollers 8*c* and 8*d* in the same manner.

In a situation where, as shown in the timing chart of FIG. 5 with respect to an image forming apparatus B' using the conventional cleaning bias method, the photosensitive drums 1*a* to 1*d* are rotated at the maximum speed, i.e., the same process speed as that at the time of development, until a time after the time (t9) at which application of the cleaning bias at the fourth station Bk is stopped, that is, from pre-rotation to the end of post-rotation, toner can change largely in characteristics with a lapse of time under the influence of variations in temperature and humidity in the apparatus. Then, the reduction in toner particle size, chargeability degradation, etc., due to the change with a lapse of time, may result in a reduction in the capability of toner being influenced by an electric field. In the transferring belt cleaning mechanism, in such a case, reverse transfer of toner to the photosensitive drums 1*a* to 1*d* becomes difficult to perform, the cleaning effect is reduced, and the likelihood of failure to sufficiently clean the transferring belt 10 is increased.

In the image forming apparatus B of this embodiment, as can be understood from the timing chart of FIG. 5, the cleaning bias is applied to each of the transferring rollers 8*a* to 8*d* when the process speeds of the photosensitive drums 1*a* to 1*d* and the developing sleeves 41 are reduced for the purposed of lightening toner degradation, as in Embodiment 1. That is, cleaning of the transferring belt 10 is performed when a peripheral velocity difference is caused between the transferring belt 10 and the photosensitive drums 1*a* to 1*d*.

Figure 6:
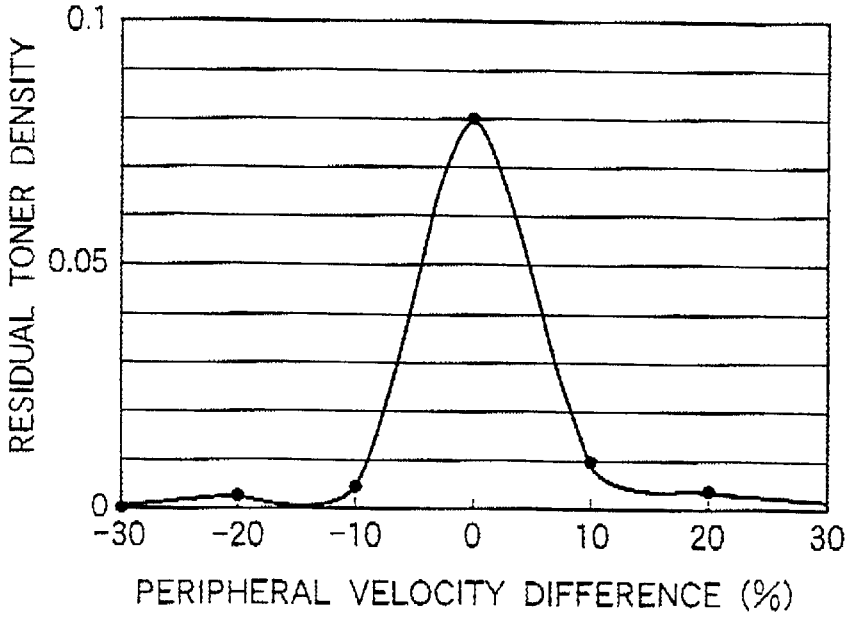
FIG. 6 is a graph of the residual toner density of an intermediate transferring belt and the difference between the peripheral velocities of an intermediate transferring belt and a photosensitive drum (%).

FIG. 6 shows the relationship between the density of toner remaining on the transferring belt 10 and the difference between the peripheral velocities of the transferring belt 10 and the photosensitive drums 1*a* to 1*d* after printing on one print sheet.

The peripheral velocity difference shown in the graph of FIG. 6 was calculated by an equation:

Peripheral velocity difference=(speed of movement of transferring belt−rotational speed of photosensitive drum)/speed of movement of transferring belt.

As can be understood from this result, the difference between the effect of cleaning the transferring belt 10 when the photosensitive drums 1*a* to 1*d* are rotated at a speed higher than that of the transferring belt 10 and the cleaning effect when the photosensitive drums 1*a* to 1*d* are rotated at a speed lower by the same amount than that of the transferring belt 10 is negligibly small, and the cleaning effect depends on the difference between the peripheral velocities of the transferring belt 10 and the photosensitive drums 1*a* to 1*d*. To perform cleaning of the photosensitive drums 1*a* to 1*d* on the transferring belt 10 with sufficiently high efficiency and stability, it is desirable to set the difference between the peripheral velocities of the transferring belt 10 and the photosensitive drums 1*a* to 1*d* to at least 6%, preferably 10% or more, as can be understood from FIG. 6.

In the image forming apparatus B, as described above, a peripheral velocity difference is set between the transferring belt 10 and the photosensitive drums 1*a* to 1*d*, toner on the transferring belt 10 is forcibly moved by a frictional force to reduce the influence of the van der Waals force between the toner and the transferring belt 10, and the toner is charged through the transferring roller. Therefore, nonpolar toner is reduced and the influence of an electric field on the toner is increased, thereby improving the cleaning effect.

Thus, in the image forming apparatus using a cleaning bias system as a means for cleaning the transferring belt, a peripheral velocity difference is set between the rotational speeds of the photosensitive drums and the transferring belt to improve the effect of cleaning transferring belt by bias cleaning. The need for provision of a cleaning apparatus (cleaning blade, waste toner container) specially designed for use with the transferring belt is thus eliminated, whereby the degree of design freedom is increased, and the manufacturing cost of the image forming apparatus can be reduced.

Any cleaning bias may suffice if transfer residual toner remaining with different polarities on the transferring belt can be efficiently removed. In this embodiment, a cleaning bias of +1.0 kV is applied to the transferring rollers 8*a* and 8*d*, while a cleaning bias of −1.5 kV is applied to the transferring rollers 8*b* and 8*c*. The method selecting of the polarity of each of the biases respectively applied to the transfer rollers in the process stations in relation to the polarity of the others, and the voltage of each cleaning bias are not limited to those described above.

Embodiment 3

The transferring system in the image forming apparatus of the present invention is not limited to that in the image forming apparatus A shown in FIG. 1. The present invention can also be applied to a type of transferring system such as that in an image forming apparatus C shown in FIG. 7, in which toner images are transferred onto an image receiving member or intermediate transferring member 10' by being superposed one on another to form a multicolor toner image in a primary transfer step, and the toner image is transferred at a time onto transferring material P in a secondary transfer step.

A color electrophotographic apparatus designed as this type of image forming apparatus using intermediate transferring belt 10' can transfer an (image from the intermediate transferring belt without requiring working and control (e.g., holding on a gripper, attraction, and creating a curvature) on the transferring material and therefore has the advantage of enabling selection of the transferring material from various kinds of materials such paper sheets varying largely in thickness (from 40 g/m$^2$ paper to 200 g/m$^2$ paper), e.g., envelops, postcards, and label paper regardless of variations in width, length, and thickness. Various products have been designed as this type of image forming apparatus and put to practical use.

Figure 7:
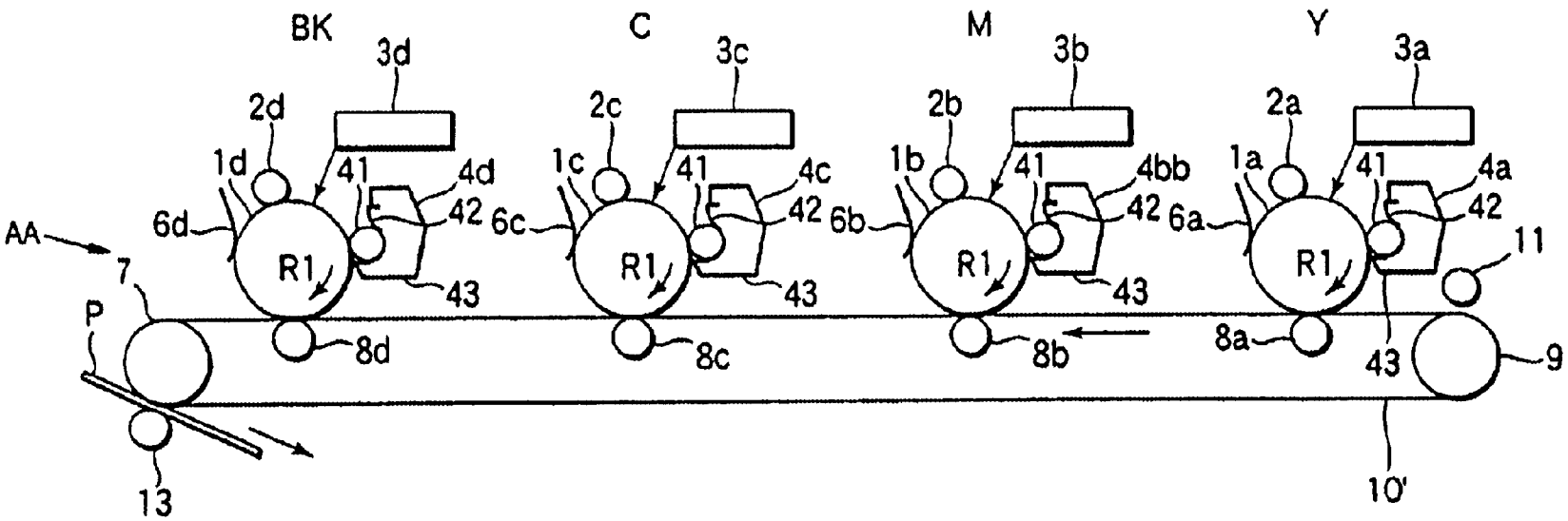
FIG. 7 is a diagram showing the construction of an image forming apparatus A of the present invention.

An example of an inline-type of image forming apparatus using an intermediate transferring member will be described referring to FIG. 7. FIG. 7 is a schematic cross-sectional view of an image forming apparatus AA designed as a four tandem drum type of color image forming apparatus. The image forming apparatus AA has photosensitive drums 1*a* to 1*d*, which are electrostatic latent image bearing members, which face developing apparatuses 4*a* to 4*d* containing developers of different colors: yellow, magenta, cyan, and black, and which are disposed one after another along the direction of movement of an intermediate transferring member or intermediate transfer belt 10'. Toner images of the different colors respectively developed on the drums 1*a* to 1*d* by the developers provided in the developing apparatuses 4*a* to 4*d* are successively transferred onto the intermediate transferring belt 10', thereby obtaining on the transferring belt 10' a full-color image from the four color toners, i.e., yellow, magenta, cyan, and black toners.

As shown in FIG. 7, the endless intermediate transferring belt 10' is wrapped around a drive roller 7 and a driven roller 9 and is rotated in a direction (the counterclockwise direction indicated by the arrow in FIG. 7) opposite to the direction of rotation of the rotary drums 1*a* to 1*d*. The four photosensitive drums 1*a* to 1*d* are disposed in series each facing the intermediate transferring belt 10'. Process stations Y, M, C, and Bk, which are color image forming means, are constituted of photosensitive drums 1*a* to 1*d*, charging means 2*a* to 2*d*, exposing means 3*a* to 3*d*, and developing means 4*a* to 4*d*. These components are disposed around the photosensitive drums 1*a* to 1*d*.

That is, in the image forming apparatus AA shown in FIG. 7, the first to fourth independent image forming means, i.e., process stations Y, M, C and Bk using yellow (Y), magenta (M), cyan (C), and black (Bk), are provided along the direction of movement of the intermediate transferring belt 10'. The color process stations Y, M, C and Bk have the photosensitive drums 1*a* to 1*d*, which are photosensitive bodies, developing apparatuses 4*a* to 4*d*, charging means 2*a* to 2*d*, exposing means 3*a* to 3*d*, cleaning blades 6*a* to 6*d*, which are photosensitive drum cleaning means, and transferring members 8*a* to 8*d*. The process stations Y, M, C and Bk are identical to each other in structure except that different color toners Y, M, C, and Bk are respectively provided in the developing apparatuses 4*a* to 4*d*.

The image forming operation of this image forming apparatus will be described. Each of the surfaces of the photosensitive drums 1*a* to 1*d* uniformly charged by the charging means, i.e., the charging rollers 2*a* to 2*d*, is irradiated by the corresponding one of the exposure means 3*a* to 3*d* with a laser beam modulated in correspondence with image data from a host such as a personal computer, thereby obtaining the desired electrostatic latent image for one of the colors. This latent image is visualized as toner image at a development position by reversal developing performed by one of the developing apparatuses 4*a* to 4*d* facing the photosensitive drum and containing the corresponding color toner. Toner images obtained in this manner are successively transferred onto the intermediate transferring belt 10' by primary transfer to be combined into a multicolor toner image. This toner image, formed on the intermediate transferring belt 10', is brought into contact with the surface of transferring material P at a position downstream of the process stations Y, M, C, and Bk in the direction of the movement of the intermediate transferring belt 10' when the transferring material P is conveyed to the contact position by conveying means after being forwarded by feed means (not shown). The combined toner image is then transferred onto the transferring material P by a secondary transferring bias applied to a secondary transferring member or secondary transferring roller 13 conveying the transferring material P while holding the same in a pinching manner. The transferred multicolor toner image is molten and fixed by a fixing apparatus (not shown) to be permanently fixed on the transferring material P, thereby obtaining the desired color print image.

The rotational speed of each of the photosensitive drums 1*a* to 1*d* and the developing sleeves 41 in the process stations Y, M, C, and Bk is set and changed by the same method as the above-described method in Embodiment 1, and the rotational speed of the developing sleeves 41 is reduced, thereby reducing chances of rubbing of toner and the developing blade 42 and, hence, image defects due to toner degradation. Therefore, it is possible to extend the life of toner without considerably reducing the life of the drum and to realize an image forming apparatus smaller in size, having a reduced manufacturing cost, and capable of operation with a wide variety of transferring materials.

Figure 2:
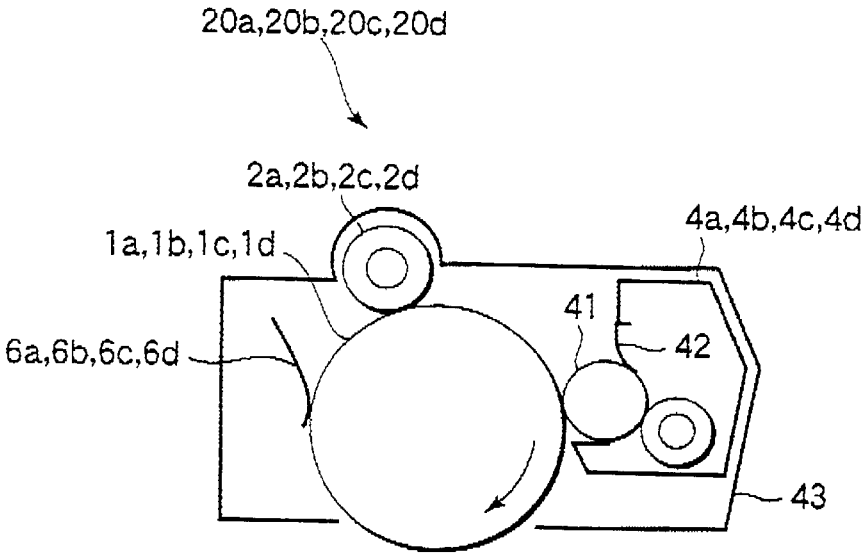
FIG. 2 is a schematic cross-sectional view of a process cartridge detachably attachable to the image forming apparatus.

Also in the image forming apparatus AA, it is preferable to form a process cartridge, such as that shown in FIG. 2, as each of the first to fourth process stations.

The means for cleaning the intermediate transferring belt may be of a blade type such as that in Embodiment 1. However, a bias cleaning system such as the above-described one in Embodiment 2 may also be used. In such case, the same effect of bias cleaning on the intermediate transferring belt is expected.

While the above-described embodiments are examples of application of the present invention to a color image forming apparatus having a plurality of photosensitive bodies, the present invention can also be applied to a monochromic image forming apparatus having only one photosensitive body.

In the image forming apparatus of the present invention, as described above, the peripheral velocity of the developer carrying member is lower during the non-development period than during the development period. Therefore, it is possible to extend the life of toner without considerably reducing the life of the electrostatic latent image bearing member and to realize an image forming apparatus smaller in size and having a reduced manufacturing cost.

The present invention is not limited to the above-described embodiments, and various modifications of the invention may be made without departing from the technical spirit of the invention or from the scope of the appended claims.

What is claimed is:

1. An image forming apparatus comprising:

an image bearing member; and a developer carrying member, which carries a developer to develop an electrostatic image formed on said image bearing member with the developer, wherein, in a non-development time period, a peripheral velocity of said developer carrying member is slower than the peripheral velocity of said developer carrying member during a development time period, and wherein a peripheral velocity of said image bearing member during the non-developmental time period is slower than the peripheral velocity of said image bearing member during the development time period.

2. An image forming apparatus according to claim 1, wherein the peripheral velocity of said developer carrying member during the non-developmental time period is ⅔ or less of the peripheral velocity of said developer carrying member during the development time period.

3. An image forming apparatus according to claim 1, wherein a direction of movement of said developer carrying member at a development position on said image bearing member is the same as a direction of movement of said image bearing member.

4. An image forming apparatus according to claim 3, wherein the peripheral velocity of said developer carrying member is faster than the peripheral velocity of said image bearing member.

5. An image forming apparatus according to claim 1, wherein a ratio of the peripheral velocity of said developer carrying member and the peripheral velocity of said image bearing member is constant in the non-developmental time period and the development time period.

6. An image forming apparatus according to claim 1, wherein the developer is a non-magnetic, one-component developer.

7. An image forming apparatus according to claim 1, wherein said developer carrying member is disposed so as to be able to contact said image bearing member.

8. An image forming apparatus according to claim 1, further comprising a regulating member for regulating an amount of the developer carried on said developer carrying member, said regulating member being disposed in pressure contact with said developer carrying member.

9. An image forming apparatus according to claim 1, further comprising a supply member for supplying the developer to said developer carrying member, said supply member being disposed in pressure contact with said developer carrying member.

10. An image forming apparatus according to claim 1, wherein said developer carrying member is rotatable.

11. An image forming apparatus according to claim 1, wherein said image bearing member and said developer carrying member are provided in a process cartridge detachably attachable to a main body of said image forming apparatus.

12. An image forming apparatus comprising:

a plurality of image forming means, each of which includes an image bearing member, and a developer carrying member, which carries a developer to develop an electrostatic image formed on said image bearing member with the developer; and transferring means for transferring an image formed on each said image bearing member to an image receiving member, wherein, in at least one of said plurality of image forming means, a time period, during which a peripheral velocity of said developer carrying member is slower than the peripheral velocity of said developer carrying member during a development time period, is set as a non-development time period.

13. An image forming apparatus according to claim 12, wherein the image receiving member is a transferring material, and said apparatus further comprises a transferring material conveying member, which conveys the transferring material.

14. An image forming apparatus according to claim 13, wherein an electric field for returning residual developer from said transferring material conveying member to said image bearing member is formed during a non-transfer time period.

15. An image forming apparatus according to claim 14, wherein a peripheral velocity difference between the peripheral velocity of said image bearing member and the peripheral velocity of said transferring material conveying member when the electric field is formed is 6% or more.

16. An image forming apparatus according to claim 12, wherein said image receiving member is an intermediate transferring member.

17. An image forming apparatus according to claim 16, wherein an electric field for returning residual developer from said intermediate transferring member to said image bearing member is formed during a non-transfer time period.

18. An image forming apparatus according to claim 17, wherein a peripheral velocity difference between the peripheral velocity of said image bearing member and the peripheral velocity of said intermediate transferring member when the electric field is formed is 6% or more.

19. An image forming apparatus according to claim 12, wherein the peripheral velocity of said developer carrying member during the non-developmental time period is ⅔ or less of the peripheral velocity of said developer carrying member during the development time period.

20. An image forming apparatus according to claim 12, wherein a direction of movement of said developer carrying member at a development position on said image bearing member is the same as a direction of movement of said image bearing member.

21. An image forming apparatus according to claim 20, wherein the peripheral velocity of said developer carrying member is faster than the peripheral velocity of said image bearing member.

22. An image forming apparatus according to claim 12, wherein the peripheral velocity of said image bearing member during the non-developmental time period is slower than the peripheral velocity of said image bearing member during the development time period.

23. An image forming apparatus according to claim 22, wherein a ratio of the peripheral velocity of said developer carrying member and the peripheral velocity of said image bearing member is constant in the non-developmental time period and the development time period.

24. An image forming apparatus according to claim 22, wherein the developmental time period is a portion of an image forming time period extending from a start of charging for forming the electrostatic image on said image bearing member to a completion of transferring an image formed on said image bearing member with developer to said image receiving member.

25. An image forming apparatus according to claim 12, wherein the developer is a non-magnetic, one-component developer.

26. An image forming apparatus according to claim 12, wherein said developer carrying member is disposed so as to be able to contact said image bearing member.

27. An image forming apparatus according to claim 12, further comprising a regulating member for regulating an amount of the developer carried on said developer carrying member, said regulating member being disposed in pressure contact with said developer carrying member.

28. An image forming apparatus according to claim 12, further comprising a supply member for supplying the developer to said developer carrying member, said supply member being disposed in pressure contact with said developer carrying member.

29. An image forming apparatus according to claim 12, wherein said developer carrying member is rotatable.

30. An image forming apparatus according to claim 12, wherein said image bearing member and said developer carrying member are provided in a process cartridge detachably attachable to a main body of said image forming apparatus.

* * * * *

UNITED STATES PATENT AND TRADEMARK OFFICE

CERTIFICATE OF CORRECTION

PATENT NO. : 6,643,484 B2
DATED : November 4, 2003
INVENTOR(S) : Katsuhiro Kojima et al.

It is certified that error appears in the above-identified patent and that said Letters Patent is hereby corrected as shown below:

Column 3,
Line 18, “all of” should read -- all of the --;
Line 22, “after-image” should read -- after image --; and
Line 29, “colors,” should read -- colors; --.

Column 7,
Line 19, “produces” should read -- produce --.

Column 8,
Line 3, “to an” should read -- to a --;
Line 17, “omitting” should read -- omitting the --;
Line 25, “steed” should read -- speed --; and
Line 29, “temporality” should read -- temporarily --.

Column 10,
Line 61, “scratches in” should read -- scratches on --.

Column 11,
Line 18, “used” should read -- be used --.

Column 12,
Line 21, “photosensitive” should read -- photosensitive drum --;
Line 46, “characteristics” should read -- characteristic --; and
Line 61, “purposed” should read -- purpose --.

UNITED STATES PATENT AND TRADEMARK OFFICE

CERTIFICATE OF CORRECTION

PATENT NO. : 6,643,484 B2
DATED : November 4, 2003
INVENTOR(S) : Katsuhiro Kojima et al.

It is certified that error appears in the above-identified patent and that said Letters Patent is hereby corrected as shown below:

Column 14,
Line 3, “(image” should read -- image --;
Line 4, “working” should read -- work --;
Line 7, “such” should read -- such as --; and
Line 16, “four tandem drum type” should read -- four tandem-drum-type --.

Signed and Sealed this

Thirtieth Day of March, 2004

JON W. DUDAS
*Acting Director of the United States Patent and Trademark Office*